United States Patent [19]

Reisman

[11] Patent Number: 4,905,449

[45] Date of Patent: Mar. 6, 1990

[54] PACKING PLATTER FOR FOODS, WITH DECORATIVE TAB-ENGAGED STRIP

[75] Inventor: Howard Reisman, Moorestown, N.J.

[73] Assignee: Boca Foods, Inc., Harrison, N.J.

[21] Appl. No.: 310,771

[22] Filed: Feb. 14, 1989

Related U.S. Application Data

[62] Division of Ser. No. 230,311, Aug. 9, 1988, Pat. No. 4,836,363.

[51] Int. Cl.[4] ..... B65B 61/00

[52] U.S. Cl. ..... 53/410; 53/452; 493/390; 493/955

[58] Field of Search ..... 53/410, 452; 493/350, 493/390, 902, 955; D7/27; D9/428, 429, 456; 206/45.32, 45.33, 44 R, 457

[56] References Cited

U.S. PATENT DOCUMENTS

| | | | |
|---|---|---|---|
| D. 166,940 | 6/1952 | Ambellan | D44/10 |
| D. 228,402 | 9/1973 | Meszaros | D9/429 |
| D. 230,338 | 2/1974 | St. Andre | D7/99 |
| D. 267,543 | 1/1983 | Nemura et al. | D9/3 |
| 412,604 | 10/1889 | Croggon . | |
| 3,969,992 | 7/1976 | Calderazzo | 493/350 |
| 4,133,922 | 1/1979 | Smith | D7/27 |
| 4,705,163 | 11/1987 | James | 206/45.32 |

*Primary Examiner*—John Sipos

*Attorney, Agent, or Firm*—Steele, Gould & Fried

[57] ABSTRACT

A decorative packing platter for foods has a planar member such as a cardboard plate having a central area for receiving the foods and a periphery. Receptacle tabs are formed, for example by die cutting, each tab having a proximal end attached to the platter and a distal end, the tab and the platter together defining a receptacle opening into which a decorative border strip is placed. The border strip becomes captive in the receptacle opening, defining a decorative edging or border. The tabs can be oriented outwardly or inwardly and in several shapes. A plastic sheet or other protective member can be placed between the food product and the platter and around the packing platter generally. The platter is especially useful for packing cookies.

2 Claims, 3 Drawing Sheets

PACKING PLATTER FOR FOODS, WITH DECORATIVE TAB-ENGAGED STRIP

This is a division of application Ser. No. 230,311, filed Aug. 9, 1988, now U.S. Pat. No. 4,836,363.

BACKGROUND OF THE INVENTION

1. Field of the Invention

This invention relates to the field of packing materials, and in particular to a decorative platter with a decorative strip mounted under receptacles formed by tabs raised from the surface of the platter. The invention also concerns a method and apparatus for making the platter, including a movable pin arrangement for temporarily lifting the tabs to receive the strip. The decorative platter of the invention is particularly useful for foods such as cookies.

2. Prior Art

Packing and display trays for foods are known in various embodiments, including those having decorative edging configurations at the periphery of trays, bowls and/or plates. U.S. Design Pat. No. 267,543-Nemura et al discloses a plate with flower-like edging, the plate being integrally molded plastic. In U.S. Design Pat. No. 230,338-St. Andre et al, a similar molded plate is provided with a configuration having alternating open slots around a periphery. These patents do not disclose affixing any form of decorative edging, but rather provide a decorative integrally molded shape.

U.S. Pat. No. 412,604-Croggon discloses a cup having raised tabs for attachment of a sponge for wetting items using the sponge. This product of this patent is not useful as a convenient packing means for food products, especially cookies. Similarly, U.S. Design Pat. 166,940-Ambellan discloses a plywood bowl having cut edge configurations which are deformed to cause the cut plywood to assume an arch.

A decorative plate for cookies and the like is available from Lady Mary, Inc., and is known as a "party tray". This tray is characterized by a circular cardboard sheet with pleated ribbon sewn directly to the cardboard, the stitches passing through the cardboard and through the pleated ribbon. The pleated ribbon is flat notwithstanding the circular configuration of the ribbon, adjacent folds of the pleats thus diverging outwardly relative to the circular tray. The party tray is provided with a plastic cover sheet, concealing the stitching through the ribbon and cardboard plate.

The Lady Mary, Inc. plate, is relatively expensive to make as it and requires an extra sewing operation to that already required to stitch the pleating of the decorative strip. Stitching requires rather precise mechanical controls in order to feed the thread, tension the thread, etc. If these controls are not correct, the stitching can be loose or otherwise come undone. The stitching is effective with corrugated cardboard, but would not be possible, or may be unduly dangerous, with material not readily pierced with a sewing needle.

It is also possible to staple decorative edging around a planar member. This also can be a dangerous prodedure for operator, to planar material is not readily pierced. Furthermore, staples are dangerous in connection with food products because any staples which come loose could be inadvertently associated with the food product and eaten by a customer, with possible damage. Similarly, it would be possible to glue a decorative strip around the edge of a tray. Gluing is not preferred because the glue is a foreign substance that may not be appropriately used in close proximity with food. Odor exuded by the glue may be absorbed by the food product. Pieces of glue may come free of the planar member and/or decorative strip, and become associated with the food and eaten. For all these reasons, means apart from the integral structure of the plate and ribbon, have some drawbacks that could be improved.

The present invention mounts a pleated ribbon on a cardboard tray or the like using tabs which are preferably die cut and are raised from the tray in order to form a plurality of receptacles for the ribbon, angularly spaced around the circumference of the tray. The tray can be a circular plate and the tabs can be defined by substantially U-shaped die cuts, the distal end of the tabs being oriented either radially outwardly or radially inwardly to receive a pleated ribbon. The pleated ribbon is preferably squarely pleated, i.e., with parallel adjacent folds that, when placed in a circular configuration under the tabs, become flared. A protective sheet is preferably placed over the tray in the central area between the tabs, however, the tabs can themselves be decorative and need not be concealed. Moreover, the tabs form a slightly bowl-like configuration tending to keep the food products in place on the tray. The overall tray can also be covered with a protective sheet.

The invention concerns the packing platter and also a method and an apparatus for making it. The platter itself is a tray or similar planar member provided with receptacle tabs receiving the border strip, such as a pleated ribbon. The method includes the steps of cutting out the tray and forming the receptacle tabs, raising the tabs and mounting the decorative strip. An apparatus for making the packing platter includes means for registering the tray in place and movable members temporarily lifting the tabs for receipt of the strip. A contact block can be used to compress the platter and lock the ribbon in place. The packing platter as disclosed is less expensive and structurally improved over known packing receptacles for cookies and the like, for example the aforesaid Lady Mary, Inc. party tray.

SUMMARY OF THE INVENTION

It is an object of the invention to provide an inexpensive and easy to produce packing tray for foods such as cookies, cakes and the like, the packing tray being characterized by a decorative edging.

It is another object of the invention to mount decorative edging without the need for complex or expensive machinery.

It is a further object of the invention to improve the decoration of packing trays while at the same time producing structural characteristics that are beneficial for packing purposes.

It is yet another object of the invention to facilitate production of the packing tray using inexpensive and durable apparatus and method steps.

These and other objects are accomplished by a platter and apparatus for display of goods and a method for making the platter, the platter including a planar member defining a central area and a periphery, at least one receptacle tab being formed between the central area and the periphery, the receptacle tab having a proximal end attached to the platter and a distal end spaced above the planar member of the platter, the tab and the planar member together defining a receptacle opening. A border strip extends around at least a portion of the periphery of the planar member, the border strip being captive in the receptacle opening, whereby the border strip defines a decorative edging around goods placed in the central area. The receptacle tabs can open outwardly or inwardly with respect to the central area, or can be staggered for a more decorative effect. The tabs are preferably U-shaped, die cut formations and may have a scalloped or other decorative distal edge. The border strip is preferably pleated ribbon having parallel successive pleats such that upon bending the ribbon in a circular arch the pleats tend to flare.

The method of the invention includes die cutting the planar members from a sheet, and die cutting the receptacle tabs. The receptacle tabs are then bent upwardly from the sheet and the decorative edging strip is inserted. Preferably the decorative edging strip is a pleated ribbon which is flared during insertion of the strip. The tabs can be pressed downwardly to lock the ribbon in place and a protective covering is applied to the central area, whereupon food products can be located therein and will remain in place between the receptacle tabs.

The apparatus of the invention for producing the tray includes a table element with means engaging the tray to retain the tray in registry, a plurality of movably advanced pins aligned with the tabs and movable to protrude from the table and lift the tabs for receipt of the border strip, and means for rotating one of the tray and a means supplying the strip relative to the other. Clamps can be provided as well to retain the tray during the process and to press down the tabs against the strip to better lock the strip in place.

BRIEF DESCRIPTION OF THE DRAWINGS

There are shown in the drawings the embodiments that are presently preferred. It should be understood, however, that the invention is not limited to the precise embodiments shown in the drawings and is capable of embodiment in other groupings of particular features. In the drawings.

DETAILED DESCRIPTION OF THE PREFERRED EMBODIMENTS

Figure 1:
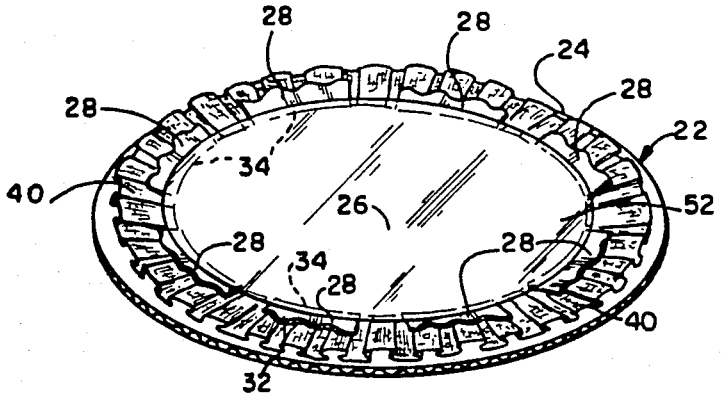
FIG. 1 is a perspective view of a decorative packing plate, tray or platter according to the invention.
Figure 10:
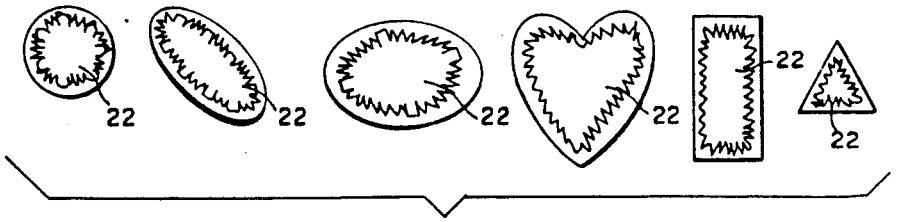
FIG. 10 is a plan view of a number of alternative platter shapes.

As shown in FIG. 1, a decorative plate, tray or platter for display of goods includes a preferably planar member 22 defining a central area 26 and a periphery 24. The planar member 22 as shown is a circular plate, however, it is also possible to arrange the plate as an oval, square, polygon or other configuration, for example, as shown in FIG. 10. The plate can be a bowl shape, but at least a peripheral portion is planar, for receipt of a decorative ribbon 40 or the like. The planar member 22 can be formed of any material formable enough to be die cut and bent along folds to raise tabs, for example card stock, sheet metal, solid or microcellular plastic (e.g., polystyene) or the like. Preferably, the planar member 22 is formed of corrugated craft cardboard, possibly with a bleached or colored upper-facing surface. The upper surface can likewise be impregnated with plastic for waterproofing and increased resilience. The plate can be printed with decorative indicia or can be cut in a patterned outline to form a decorative outermost edge.

Between the central area 26 and the periphery 24 are provided a plurality of receptacle tabs 28. The receptacle tabs each have a proximal end 34, attached integrally with the planar member 22, and a distal end 32, bent slightly upwardly from the planar member 22 for receipt of a decorative strip. A receptacle opening is formed between each tab 28 and the plane defined by the planar member by bending tab 28 upwardly. The receptacle opening narrows toward end 34, receiving and holding a decorative edging material such as pleated ribbon 40.

Ribbon 40 can be formed in a closed circular configuration before placement on planar member 22. In that event, receptacle tabs 28 must be folded upwardly until perpendicular to the plane of planar member 22, whereupon the ribbon can be fit down and the tabs folded again downwardly to retain the ribbon in place. Preferably, ribbon 40 is provided in linear strips of pleated ribbon sewn on one side.

The ribbon can be a two part material having a waterproof layer such as decoratively printed plastic film, and a net layer affixed to the waterproof layer. The ribbon is urged under each successive receptacle tab 28 while relatively rotating the planar member 22, the receptacle tabs being only slightly lifted above the plane of member 22, and thereby defining a receptacle narrowing toward the central area 26. By urging ribbon 40 more tightly toward the central area and further into the narrow end of the V-shape receptacles formed between tab 28 and planar member 22, the user controls the tightness of attachment of ribbon 40 to planar member 22. Furthermore, the ribbon becomes forced downwardly somewhat by tabs 28, from the precise plane of the top surface of planar member 22, the ribbon being fixed securely in place. It is furthermore possible to press receptacle tabs down again more closely toward the plane of the top surface to lock the ribbon in place.

Due to insertion of the ribbon 40, at least the distal ends 32 of receptacle tabs 28 reside above the plane of planar member 22. The receptacle tabs 28 as a group thus define a slightly bowl-shaped configuration which tends to retain food products such as cookies in the central area. Furthermore, as shown in FIG. 2, ribbon 40 is preferably provided in the form of ribbons having parallel folds such that upon bending the ribbon around a curve such as the circular arch required to follow the periphery of plate 22, the outer circumferential edge is relatively elongated (or the inner edge foreshortened), thereby tending to cause the pleated ribbon 40 to flare on its outer periphery and thereby increasing the bowl-shape of the configuration, tending to keep the cookies, food products or other articles in place.

Figure 2:
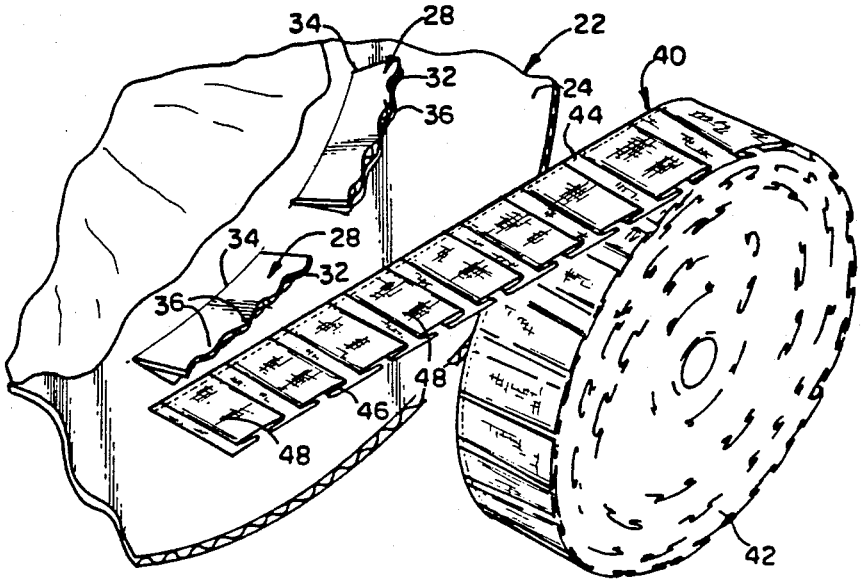
FIG. 2 is a partial perspective view showing attachment of the decorative strip and the protective covering to the planar member.

FIG. 2 illustrates construction steps involved in forming the decorative platter of the invention. The outline of plate 22, preferably of corrugated craft cardboard as shown, is die cut, as are the outlines of individual receptacle tabs 28. This can be done in one step with an appropriate die, or in a plurality of steps using separate dies for the outline and for the tabs.

The outer periphery can be decoratively scalloped if desired. The tabs are positioned to hold the ribbon at a slight space from the extreme edge of the plate 22, thereby preventing interference between any external plastic covering sheet and the radially outermost edge of the ribbon. Prior to affixing pleated ribbon 40, the receptacle tabs 28 are lifted slightly upward from the plane of plate 22 along fold line 34. This can be done using a movable pin table, as discussed hereinafter. The side of pleated ribbon 40 having a sewn (or possibly glued) edge 44 is placed under tabs 28. Receptacles tab 28 can then be pushed down slightly, if desired. In wrapping the ribbon around the tabs, the successive pleats 48 of ribbon 40, provided as shown in FIG. 2 with parallel folds, must assume a larger circumference on the outer edge, and a shorter circumference on the inner edge. The length of the inner edge is already defined by having been sewn or glued along edge 44, and accordingly the outer edge 46 becomes elongated, whereupon the pleats flare. As a result, the pleats 48 at outer edge 46 come unfolded, such that the pleats open at the outer edge of the strip 40 (and accordingly the strip 40) become thicker adjacent the periphery of the plate. This contributes to bowl-like configuration of the platter, especially suited for packing of cookies and the like, which are relatively small and movable. The arrangement is likewise apt for cakes and the like, which tend to remain centered on the plate 22 due to the bowl like configuration defined by the plate 22, tabs 28 and strip 40.

As also shown in FIGS. 1 and 2, a central decorative panel 52 can be included, for example a plastic sheet, which will keep any oils from soaking from the food product into the cardboard material of the platter. Preferably the central sheet 52 at least slightly overlaps the receptacle tabs 28. While it is possible to completely conceal receptacle tabs 28 under sheet 52, preferably tabs 28 extend beyond the edge thereof. Receptacle tabs 28 are decorative in themselves and can be provided with scalloped outer edges as shown, to be superimposed on pleated ribbon 40. Protective layer 52 can be glued to planar member 22, if desired, or simply placed in central area 26 where the bowl-shaped configuration of the receptacle tabs 24 tends to keep the protective sheet 52 in place.

Figure 3:
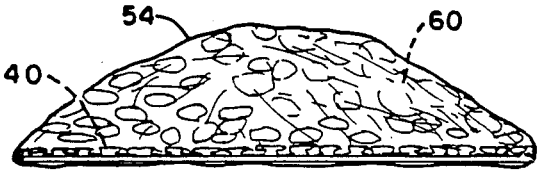
FIG. 3 is an elevation view of the platter with a food product mounted therein and the entire platter being covered.

FIG. 3 is a side elevation view of the decorative packing platter of the invention, with a food product 60 disposed therein and the entire arrangement covered by an outer protective sheet 54.

If ribbon 40 is too close to the edge of plate 22, there is a danger that the sheet 54 will fold ribbon 40 radially inward when put in place. To avoid this, ribbon 40 is spaced slightly (e.g., a quarter inch) from the edge. As seen in FIG. 3, the flaring outer edges of pleated ribbon 40 define an inwardly sloping edge, also assumed by receptacle tabs 28 (not shown in FIG. 3). Accordingly, food product 60 remains centrally placed on planar member 22. After enclosing the overall plate and contents in a decorative outer sheet 54, for example clear plastic wrap, the packaged food product 60, for example cookies, remain visible, decoratively packaged and protected against dirt, moisture, or damage due to josteling of the contents.

Figure 4:
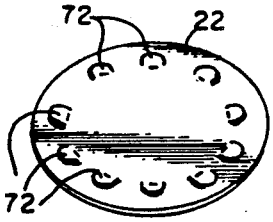
FIGS. 4, 5 and 6 are perspective views of alternative embodiments wherein the receptacle tabs are in alternative configurations and/or orientations.
Figure 5:
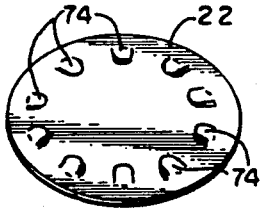
Figure 6:
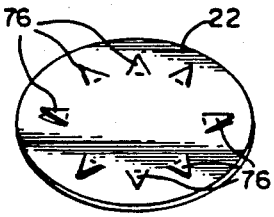

FIGS. 4, 5 and 6 illustrate alternative embodiments, wherein the receptacle tabs 28 are formed in different shapes. In each case, the receptacle tabs are cut out from substantially U-shaped slots cut in planar member 22 and angularly spaced around the periphery of the planar member, tabs 28 being integrally formed therewith by die cutting or the like. In FIG. 4, the receptacle tabs 72 are rounded, being cut from a precisely U-shaped slot, having rounded outer edges for receiving the decorative strip, such as a pleated ribbon. In FIG. 5, the receptacle tabs are also precisely U-shaped, however, in this case they face inwardly, being disposed around the outside edge and forming a means for receiving an inwardly- ruffled decorative strip. In FIG. 5, the strip will be arranged such that the radially inward edges of the pleats will be relatively compressed with respect to the outer edge, which would include the line of folding or sewing similar to edge 44 pleated ribbon 40. According to FIG. 5, the receptacle tab should be spaced slightly inwardly from the outer edge such that the slots in plate 22 on either side of the tabs do not easily rip through the peripheral edge of planar member 22.

Other shapes for the receptacle tabs are likewise possible. FIG. 6 shows a triangular or V-shaped outwardly facing tab 76. The U-shaped, scalloped and V-shaped configurations can be combined and/or varied as required to achieve the desired decorative effect. The tabs can be geometric shapes such as arcs or polygons, or can be flower shapes, filligrees or other decorative configurations. If an exposed tab decorative effect is not desired, the receptacle tabs can be completely covered by the inner cover sheet 52.

In an alternative embodiment (not shown), tabs for retaining a decorative peripheral strip are fixed on the surface of a planar member 22, rather than being cut out of the integral sheet of material. Preferably, the tabs in that case have a connecting portion radially inward of a fold similar to the fold in the illustrated embodiments, the connecting portion (only) being fixed to planar member 22. This construction also defines a receptacle for a decorative strip.

Figure 7:
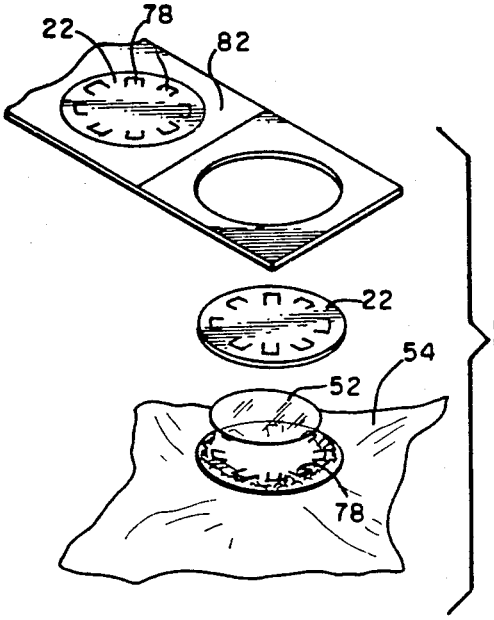
FIG. 7 is a perspective view illustrating steps in the method of forming the decorative platter.

FIG. 7 illustrates the method steps involved in forming a decorative platter according to the invention. A cardboard sheet or progression of cardboard sheets 82 are die cut in one or more steps to define the outer periphery and to form the receptacle tabs 28, in this case square shaped receptacle tabs 78. The receptacle tabs, which are cut substantially from a U-shaped slot, are integral with cardboard 82 and not wholly separable therefrom. The circular outer edge of the plate is separated from the sheet of cardboard 82 and the plate can be removed therefrom. Having been removed, at least a slight fold is formed at the top of each U-shaped cut, contiguous with the planar member, thereby lifting each receptacle tab 78 slightly above the plane of the planar member and defining an axially narrowing receptacle progressing radially inwardly. The border strip 40 is then placed under the tabs. As strip 40 is pulled tight along its length, the strip is forced further into the receptacle area under the tabs. The tabs can be pressed downwardly again, more securely engaging the strip 40, if desired. After placement of an inner cover sheet 52, a food product (not shown in FIG. 7) can be placed thereon. Finally, the outer protective sheet 54, for example transparent plastic wrap, encloses the entire package. The decorative platter as so made is attractive, but requires minimal manufacturing and no complicated or expensive steps as compared to sewing, stapling, gluing or molding of packing plates. Therefore, the decorative platter is convenient, inexpensive, yet highly durable and satisfactory for packing and shipping food products and the like, especially cookies. Moreover, the purchaser receives not only the food product, but also an attractive display means therefor, thus increasing the value of the packaged food product, and its consumer appeal.

Figure 8:
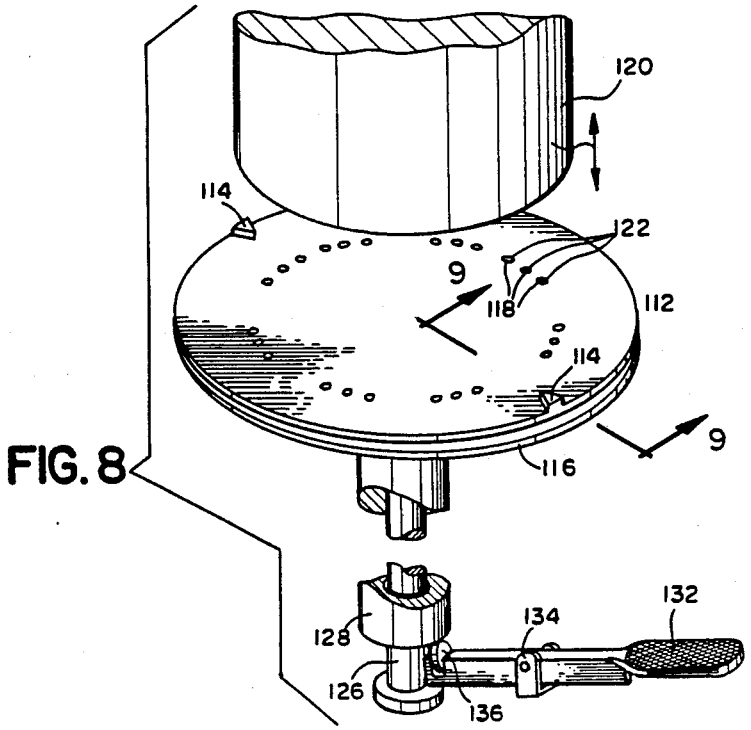
FIG. 8 is a perspective view of a table for affixing the decorative strip to the platter.
Figure 9:
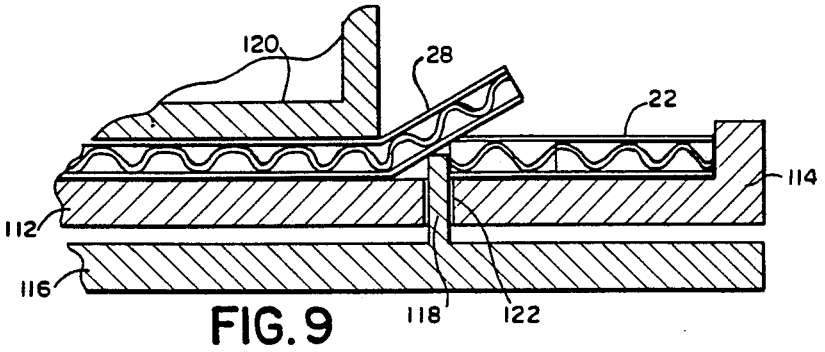
FIG. 9 is a section view through the table.

An apparatus for facilitating the assembly of plate 22 and ribbon 40 is shown in FIGS. 8 and 9. In FIG. 8, a schematic perspective view, table 112, is provided for receipt of plate 22 (shown in FIG. 9). Plate 22 can be provided with notches in its outer periphery for registering the position of tabs 28 relative to table 112. Contact points 114, which may be diametrically opposite as shown or otherwise distributed around the circumference of table 112, engage plate 22 such that each of the tabs 28 is disposed immediately over a set of pin holes 122. Having placed a plate 22 on table 112, the user operates a mechanism to raise pins 118 in holes 122, thus forcing tabs 28 upwardly out of the plane of plate 22 for receipt of decorative strip 40. It is possible to hold plate 22 down by hand, however, it is preferred that a clamping member 120 be provided to hold the plate 22 down against table 112 while pins 118 are raised in holes 122 to push tabs 28 into position for receiving decorative strip 40. As shown in FIG. 8, a pin block 116 to which pins 118 are affixed is movably disposed underneath table 112, with some space being provided for motion axially relative to the center of plate 112, pin block 116 and the two shafts 126, 128, carrying table 112 and pin block 116, respectively.

Pin block 116 is affixed to axially-movable tube 128, slidably fitting on rotatable shaft 126 and thereby being axially displaceable along shaft 126. Pin block 126 being fixed at the top of tube 128, pin block 116 is also axially displaceable to thereby move pins 118 upwardly and downwardly in pin holes 122. A foot pedal assembly including pedal 132 and roller 136 movably mounted around fulcrom pin 134 allow the user to raise and lower tube 128 and pin block 116, while allowing at table 112 to be turned. Clamping means 120 can also be operated by a foot pedal if desired, or both foot pedal 132 and the means for operating clamping device 120 can be pneumatically operated, or otherwise movable in the manner required to urge tabs 28 upwardly momentarily, while allowing table 112 to rotate as the decorative ribbon 40 is feed under tabs 28.

As shown in FIG. 9, pins 118 do not extend above the upper plane of plate 22. This allows the decorative strip 40 to be freely moved about without interference from the pins. As the strip 40 is pulled more tightly, strip 40 is drawn downwardly into the space under tab 28, securely fixing the tab in place.

It is also possible to provide a further clamping means (not shown), for application to tabs 28 after decorative strip 40 is placed under tabs 28. In that event, the tab-clamping mechanism could be a tube carried with clamping means 120 and axially movable relative to means 120 in the same manner as shafts 126, 128 are relatively movable.

The embodiment of the invention as shown in FIGS. 8 and 9 is arranged to lift all the tabs at once and to rotate the table 112 and pin block 116 together as the plate 22 is rotated to receive the decorative strip in the manner illustrated in FIG. 2. It is also possible to allow table 112 and pin block 116 to be rotationally fixed, in that case employing a rotatably mounted means for feeding decorative strip 40, said means being movable circumferentially around table 112 while dispensing decorative strip 40. Decorative strip 40 can be provided in a roll or can be pre-cut to the appropriate lengths, as required. As another option, it is possible to provide a central hole in each plate 22, for engagement on a central pin (not shown) on table 112. Furthermore, the application of strip 40 can be combined with other steps such as steps involving the cutting of the plates 22, printing a design on the plates 22, (especially adjacent the edge) or other steps.

FIG. 10 illustrates a plurality of different shapes for plate 22, any of which can be employed. Not all are particularly apt for a circular strip-dispensing apparatus as shown in FIGS. 8 and 9, however, FIG. 10 shows that the shape of the plate is subject to substantial variations. These include circular, elipticle (more or less elongated), heart-shaped, rectangular, triangular, etc. In order to achieve a bowl-shape as results from passing a pleated ribbon around an arch, a circular plate works well. In the event the plate is not circular, then one can expect greater flaring of the strip 40 adjacent the areas of least radius. In some instances, for example the upper middle crease in a heart-shaped configuration, the radius becomes so small that it is appropriate to use this area for overlapping the ribbon. Similarly, at the lower point of the heart-shaped plate, another overlap can be employed.

In connection with rectangular, triangular and other shapes characterized by a sharp angular junction, the ribbon can be overlapped or passed around the angle at a curving arch, producing substantial flaring at the corners. This flaring is decorative in itself.

The invention as so disclosed is a platter for display of goods, comprising a planar member defining a central area and a periphery, at least one receptacle tab being formed between the central area and the periphery, the receptacle tab having a proximal end attached to the platter and a distal end, the tab and the planar member together defining a receptacle opening; and, a border strip extending at least around a portion of the periphery of the planar member, the border strip being captive in the receptacle opening, whereby the border strip defines a decorative edging around the goods.

The platter can have a plurality of receptacles tabs spaced around the periphery of the platter the receptacle tabs being oriented to open outwardly, with the proximal end of the tabs closer to the central area and the distal end of the tabs closer to the periphery. Each receptacle tab is preferably formed integrally with the planar member, the receptacle tab being defined by a substantially U-shaped cut in the planar member, the cut having a bottom nearer the periphery of the planar member and sides oriented approximately on a line between the central area and the periphery.

The platter can have a plurality of receptacle tabs spaced around the periphery of the platter, the receptacle tabs being oriented to open inwardly with the distal and of the tabs closer to the central area and the proximal end of the tabs closer to the periphery. Whether the tabs are oriented inwardly or outwardly, each tab is formed by a substantially U-shaped cut in the platter, the receptacles being integral with the platter and each being displaceable from a plane defined by the planar member, around a fold line adjacent a top of the U-shaped cut.

The planar member is preferably a cardboard sheet and preferably includes a plurality of receptacle tabs, for example eight, angularly spaced around the periphery. The border strip is preferably a ribbon extending around the periphery, the ribbon being held adjacent the periphery by the receptacle tabs. The receptacle tabs can have scalloped distal edges, i.e. at the bottom of the U-shaped cut, adapted to receive a sewn edge of a pleated ribbon, whereby the pleated ribbon is caused to flare on a side opposite the sewn edge when the sewn edge is disposed on a curve and placed under the receptacle tabs.

The platter can be a circular plate about 8 to 12 inches in diameter, being thereby well adapted for food products such as cookies, cakes and the like. A protective sheet prevents absorption of oils and the like is disposed on the planar member and under the food product or the like, and a second protective sheet, for example a clear transparent sheet, is disposed over the planar member and included food products, whereby the food products are protected on each side.

The invention is also a method of packing foods, comprising the steps of forming a platter from a planar member and defining a plurality of receptacle tabs, for example by making a plurality of U-shaped cuts in the planar member, the cuts being located adjacent an area of the platter to be outlined; forming at least a slight fold at a top of said U-shaped cuts, contiguous with the planar member, thereby lifting each receptacle tab from the plane of the planar member, at each said cut thereby defining a receptacle between the receptacle tab and the planar member, the receptacle tab being integral with the planar member; inserting a border strip of decorative material under a plurality of the receptacle tabs to define a decorative edging for the area of the platter to be outlined; and, filling the area with the food product. In further steps, the planar member can be provided with a protective sheet or coating prior to filling the area with the food product and the food product as well as the planar member can be externally covered with a transparent sheet after filling the area with the food product.

The invention is further an apparatus for inserting a strip under peripheral tab spaced around an edge of a planar member, the apparatus having a table for supporting the planar member, means for temporarily fixing the planar member to the table, at least one movable pin block with pins protruding into holes in the table, the pin block and table being relatively movably to urge the pins to protrude through said holes and against the planar member for lifting the tabs. A reel can be provided for dispensing the strip, the reel and the table being relatively movable to dispense the strip around a periphery of the table.

The invention having been disclosed, a number of further embodiments will now become apparent to persons skilled in the art and aware of this disclosure. Reference should be made to the appended claims rather than the foregoing specification as indicating the true scope of the invention.

I claim:

1. A method of packing foods, comprising the steps of:

forming a platter from a planar member and forming a plurality of receptacle tabs in the planar member, the tabs being located adjacent an area of the platter to be outlined;

forming at least a slight fold at a top of said tabs, adjacent the planar member, thereby lifting each of the tabs from the planar member at a distal end of the tabs and thereby defining a receptacle between the receptacle tab and the planar member, inserting a border strip of decorative material under a plurality of the receptacle tabs to define a decorative edging for the area of the platter to be outlined; and, filling the area with the food product.

2. The method of claim 1, wherein the tabs are integrally cut from the planar member by forming a substantially U-shaped cut for each tab, the tabs being integrally contiguous with the planar member.

* * * * *